US007939235B2

(12) United States Patent
Honda et al.

(10) Patent No.: US 7,939,235 B2
(45) Date of Patent: May 10, 2011

(54) IMAGE FORMATION METHOD

(75) Inventors: Takahiro Honda, Fujinomiya (JP); Hiroyuki Fushimi, Numazu (JP); Fumihiro Sasaki, Fuji (JP); Hisashi Nakajima, Numazu (JP); Hiroshi Yamada, Numazu (JP); Yasuo Asahina, Numazu (JP)

(73) Assignee: Ricoh Company Limited, Tokyo (JP)

( * ) Notice: Subject to any disclaimer, the term of this patent is extended or adjusted under 35 U.S.C. 154(b) by 614 days.

(21) Appl. No.: 12/047,807

(22) Filed: Mar. 13, 2008

(65) Prior Publication Data

US 2008/0227000 A1 Sep. 18, 2008

(30) Foreign Application Priority Data

Mar. 16, 2007 (JP) ..... 2007-067715

(51) Int. Cl.
*G03G 13/20* (2006.01)

(52) U.S. Cl. ..... 430/123.51; 430/120.1; 430/123.41; 430/124.1

(58) Field of Classification Search ..... 430/120.1, 430/123.41, 123.51, 124.1
See application file for complete search history.

(56) References Cited

U.S. PATENT DOCUMENTS

| | | | | |
|---|---|---|---|---|
| 4,980,258 | A | | 12/1990 | Aoki et al. |
| 5,061,588 | A | | 10/1991 | Fushimi et al. |
| 5,344,732 | A | | 9/1994 | Chiba et al. |
| 5,403,690 | A | | 4/1995 | Kuramoto et al. |
| 5,418,103 | A | | 5/1995 | Muto et al. |
| 5,554,478 | A | | 9/1996 | Kuramoto et al. |
| 5,652,079 | A | | 7/1997 | Mochizuki et al. |
| 5,780,195 | A | * | 7/1998 | Nava ..... 430/109.2 |
| 5,840,456 | A | | 11/1998 | Tomita et al. |
| 5,851,716 | A | | 12/1998 | Kuramoto et al. |
| 6,004,715 | A | | 12/1999 | Suzuki et al. |
| 6,074,794 | A | | 6/2000 | Fushimi et al. |
| 6,103,441 | A | | 8/2000 | Tomita et al. |
| 6,168,894 | B1 | | 1/2001 | Aoki et al. |
| 6,303,258 | B1 | | 10/2001 | Katoh et al. |
| 6,363,229 | B1 | | 3/2002 | Shiraishi et al. |
| 6,403,275 | B1 | | 6/2002 | Kuramoto et al. |

(Continued)

FOREIGN PATENT DOCUMENTS

JP 61-7844 1/1986

(Continued)

OTHER PUBLICATIONS

U.S. Appl. No. 11/938,335, filed Nov. 12, 2007, Masahide Yamada, et al.

(Continued)

*Primary Examiner* — Hoa V Le
(74) *Attorney, Agent, or Firm* — Oblon, Spivak, McClelland, Maier & Neustadt, L.L.P.

(57) ABSTRACT

A toner includes a polyol-based resin having multiple hydroxyl groups in a molecular chain thereof in which a ratio of epoxy group to hydroxyl group is from 0.990 to 1.010. A stirring and transfer device satisfies $1000000 \leqq \alpha \times \beta \times \gamma \leqq 16000000$, wherein $\alpha$ represents a number of rotation per minute, $\beta$ (mm) represents a pitch and $\gamma$ (mm) represents a transfer path length of the stirring and transfer device. A temperature Tin (° C.) in a development device during stirring and transfer of a two component developing agent satisfies 3020 C.<Tin<60° C., and the toner satisfies $Y \leqq -0.5X+45$, $5 \leqq X < 40$, $5 \leqq Y \leqq 35$, wherein X (%) represents a degree of agglomeration of a mother toner particle and Y (%) represents a degree of agglomeration of the toner which has been preserved at 55° C. for 24 hours.

3 Claims, 3 Drawing Sheets

U.S. PATENT DOCUMENTS

| | | | |
|---|---|---|---|
| 6,406,826 | B1 | 6/2002 | Suzuki et al. |
| 6,468,706 | B2 | 10/2002 | Matsuda et al. |
| 6,500,595 | B1 | 12/2002 | Mochizuki et al. |
| 6,593,048 | B2 | 7/2003 | Sasaki et al. |
| 6,667,141 | B2 | 12/2003 | Iwamoto et al. |
| 6,699,632 | B2 | 3/2004 | Higuchi et al. |
| 6,733,939 | B2 | 5/2004 | Nanya et al. |
| 6,756,175 | B2 | 6/2004 | Emoto et al. |
| 6,770,411 | B2 | 8/2004 | Masuda et al. |
| 6,787,280 | B2 | 9/2004 | Yamashita et al. |
| 6,790,575 | B2 | 9/2004 | Sasaki et al. |
| 6,818,369 | B2 | 11/2004 | Sugiura et al. |
| 6,818,370 | B2 | 11/2004 | Uchinokura et al. |
| 6,828,075 | B2 | 12/2004 | Suzuki et al. |
| 6,835,517 | B2 | 12/2004 | Kondo et al. |
| 6,846,604 | B2 | 1/2005 | Emoto et al. |
| 6,849,369 | B2 | 2/2005 | Yagi et al. |
| 6,852,462 | B2 | 2/2005 | Emoto et al. |
| 6,856,781 | B2 | 2/2005 | Matsuda et al. |
| 6,861,191 | B2 | 3/2005 | Mochizuki et al. |
| 6,911,289 | B2 | 6/2005 | Higuchi et al. |
| 6,916,587 | B2 | 7/2005 | Fushimi et al. |
| 6,924,073 | B2 | 8/2005 | Higuchi et al. |
| 6,936,390 | B2 | 8/2005 | Nanya et al. |
| 6,947,692 | B2 | 9/2005 | Kondo et al. |
| 7,056,636 | B2 | 6/2006 | Tomita et al. |
| 7,056,638 | B1 | 6/2006 | Tomita et al. |
| 7,083,890 | B2 | 8/2006 | Emoto et al. |
| 7,129,013 | B2 | 10/2006 | Higuchi et al. |
| 7,157,199 | B2 | 1/2007 | Emoto et al. |
| 7,157,201 | B2 | 1/2007 | Tomita et al. |
| 7,163,773 | B2 | 1/2007 | Sugiura et al. |
| 7,166,404 | B2 | 1/2007 | Matsuda et al. |
| 7,169,522 | B2 | 1/2007 | Sugiura et al. |
| 7,169,525 | B2 | 1/2007 | Sugiura et al. |
| 7,172,844 | B2 | 2/2007 | Umemura et al. |
| 7,258,959 | B2 | 8/2007 | Nakayama et al. |
| 7,261,989 | B2 | 8/2007 | Sugiura et al. |
| 7,288,353 | B2 | 10/2007 | Sugiura et al. |
| 7,300,736 | B2 | 11/2007 | Fushimi et al. |
| 7,303,847 | B2 | 12/2007 | Tomita et al. |
| 7,318,989 | B2 | 1/2008 | Kotsugai et al. |
| 2002/0039698 | A1 | 4/2002 | Sasaki et al. |
| 2003/0096185 | A1 | 5/2003 | Yamashita et al. |
| 2004/0067189 | A1 | 4/2004 | Sugiura et al. |
| 2004/0072091 | A1 | 4/2004 | Mochizuki et al. |
| 2004/0131961 | A1 | 7/2004 | Watanabe et al. |
| 2004/0229147 | A1 | 11/2004 | Higuchi et al. |
| 2005/0026064 | A1 | 2/2005 | Sugiura et al. |
| 2005/0089786 | A1 | 4/2005 | Sugiura et al. |
| 2005/0089787 | A1 | 4/2005 | Uchinokura et al. |
| 2005/0112488 | A1 | 5/2005 | Yamada et al. |
| 2005/0164114 | A1 | 7/2005 | Yagi et al. |
| 2005/0186498 | A1 | 8/2005 | Honda et al. |
| 2005/0208408 | A1 | 9/2005 | Uchinokura et al. |
| 2005/0208411 | A1 | 9/2005 | Nakayama et al. |
| 2006/0024097 | A1 | 2/2006 | Yamada et al. |
| 2006/0029433 | A1 | 2/2006 | Saito et al. |
| 2006/0063081 | A1 | 3/2006 | Nagatomo et al. |
| 2006/0204883 | A1 | 9/2006 | Nakayama et al. |
| 2006/0245794 | A1 | 11/2006 | Honda et al. |
| 2007/0059063 | A1 | 3/2007 | Nakayama et al. |
| 2007/0190444 | A1 | 8/2007 | Kotsugai et al. |
| 2007/0218389 | A1 | 9/2007 | Honda et al. |

FOREIGN PATENT DOCUMENTS

| | | |
|---|---|---|
| JP | 2000-305310 | 11/2000 |
| JP | 2006-308849 | 11/2006 |
| JP | 3878468 | 11/2006 |
| WO | WO 2007/052725 A1 | 5/2007 |

OTHER PUBLICATIONS

U.S. Appl. No. 11/851,475, filed Sep. 7, 2007, Yohichiroh Watanabe, et al.

U.S. Appl. No. 12/048,823, filed Mar. 14, 2008, Honda, et al.

* cited by examiner

IMAGE FORMATION METHOD

BACKGROUND OF THE INVENTION

1. Field of the Invention

The present invention relates to an image formation method.

2. Discussion of the Background

In the electrophotographic image forming apparatus such as a printer or a photocopier, a two component developing agent has been suitably used in light of image quality, durability and high speed performance. In such a two component development system, a method is taken in which a magnetic brush of a developing agent contacts with the surface of an image bearing member and the perimeter speed of the development sleeve increases relative to the perimeter speed of the image bearing member to secure the image density and improve the fine line reproducibility.

On the other hand, with the advance of full colorization, systemization and digitization, the demand for improvement on image quality, performance speed and stability have been strong in the electrophotography industry of late. In this situation, it is expected to penetrate into quick printing industry with photocopiers and various kinds of printers which can satisfy such a demand. To march into the printing market using the technology of electrophotography for use in photocopiers and various kinds of printers, it is required to maintain and secure production of quality images with a high stability at a high speed processing for an extended period of time.

In the image forming apparatus capable of producing quality images up to the standard in the printing market by rotating an image bearing member and a development sleeve, the amount of charge of a developing agent should be imparted instantly and stably maintained. Thus, in such a situation, the damage to the developing agent in the development device, specifically, the damage caused by abrasion between toner and charging member and toner and carrier, is significantly different from the case of an image forming apparatus rotating at a low or middle range speed. Due to this damage, the external additive attached to the surface of toner is embedded or buried therein so that the toner particles tend to agglomerate. Furthermore, in an image forming apparatus for use in the high speed rotation range described above, the temperature inside the apparatus easily rises due to such continuous image output for an extended period of time in comparison with an image forming apparatus for use in a low or middle rotation speed range. This also applies to the development device, which promotes agglomeration of a developing agent (toner). In addition, this agglomeration tendency is promoted by the size increase of an image forming apparatus made to deal with high speed performance, especially in the transfer path of a developing agent which is resultantly long.

In an image forming apparatus outputting images at a super high speed in which the abrasion damage between the developing agent and the charging member is large and the temperature tends to rise, part of the developing agent which has been damaged by abrasion and/or has a tendency to agglomerate in such a high temperature environment passes through the charging member in agglomeration. This results in whiteout phenomenon in which the image portion corresponding to the agglomerated developing agent is missing. Quality images are not stably output when such a phenomenon occurs.

To solve this problem, unexamined published Japanese patent application No. (hereinafter referred to as JOP) 2000-305310 describes a technology in which, in addition to a fluidizer, a resin particulate agglomeration body which is re-dispersed upon a mechanical stress is attached to the surface of toner particles. After the fluidizer is embedded or buried in toner particles, the re-dispersed resin particulates cover the surface thereof to prevent the agglomeration of the toner particles. However, both the resin particulates and the fluidizer are embedded or buried in the toner particles over an extended period of time. Thus, this technology finally depends on the agglomeration force mother toner particles have before the fluidizer and the resin particulates are attached thereto.

In JOP 2006-308849, toner agglomeration in a development device is restrained by controlling the environment (temperature and humidity) in an apparatus.

With regard to the binder resin for use in a toner, to obtain fine gloss, excellent color development and a wide fixing temperature range for a full color image, JOP S61-007844 describes a polyester resin and JOP 2003-173045 describes a polyol resin. However, when the polyester resin is used, toner tends to agglomerate, especially in the toner bottle or the development device in an image forming apparatus outputting images at a super high speed, resulting in occurrence of whiteout. When the polyol resin is used, toner agglomeration can be relatively prevented in comparison with the case in which the polyester resin is used. However, due to the existence of hydroxyl group in the polymer chain in the polyol resin, the toner slightly has a moisture absorption characteristic, which makes toner particles agglomerate in a development device. This leads to occurrence of whiteout in some cases. Therefore, the objective of stably producing quality images is not achieved.

SUMMARY OF THE INVENTION

Because of these reasons, the present inventors recognize that a need exists for an image formation method by which quality images are output without production of abnormal images such as whiteout by using a toner for solving the problems mentioned above for a super high speed image forming apparatus even when images are continuously output for an extended period of time.

Accordingly, an object of the present invention is to provide an image formation method by which quality images are output without production of abnormal images such as whiteout by using a toner for solving the problems mentioned above for a super high speed image forming apparatus even when images are continuously output for an extended period of time. Briefly this object and other objects of the present invention as hereinafter described will become more readily apparent and can be attained, either individually or in combination thereof, by an image formation method including: charging an image bearing member; irradiating the surface of the image bearing member to form a latent electrostatic image thereon; developing the latent electrostatic image with a two component developing agent including a carrier and a toner including a mother toner particle and an external additive by a development device including a stirring and transfer device for transferring and stirring the developing agent; transferring the developed image to a transfer medium; and fixing the developed image on the transfer medium, wherein the toner includes a polyol-based resin as a binder resin, the polyol based resin having multiple hydroxyl groups in a molecular chain thereof in which the ratio (EX/OH) of epoxy group (EX) to hydroxyl group (OH) is from 0.990 to 1.010, the stirring and transfer device satisfies the following relationship (I):

$$1.0\times10^{6}\leqq\alpha\times\beta\times\gamma\leqq16.0\times10^{6}$$

wherein α represents the number of rotation per minute, β (mm) represents the pitch and γ (mm) represents the transfer path length of the stirring and transfer device, a temperature Tin (° C.) in the development device during stirring and transfer of the two component developing agent satisfies the following relationship (II):

$$30° C. < Tin < 60° C.,$$

and the toner satisfies the following relationships (III):

$$Y \leqq -0.5X+45,\ 5 \leqq X \leqq 40,\ 5 \leqq Y \leqq 35,$$

wherein X (%) represents a degree of agglomeration of the mother toner particle and Y (%) represents a degree of agglomeration of the toner which has been preserved at 55° C. for 24 hours.

It is preferred that, in the image formation method mentioned above, the external additive includes an inorganic particulate and the attachment ratio of the inorganic particulate to a surface of the mother toner particle satisfies the following relationship (IV):

$$65\% \leqq (M_1/M_0) \leqq 95\%,$$

wherein $M_1$ represents the amount of the inorganic particulate attached to the mother toner particle after one minute ultrasonic treatment under the condition of a resonance frequency of 25 KHz for a surface active agent aqueous solution in which the toner is dissolved, and $M_0$ represents the amount of the inorganic particulate attached to the mother toner particle before the ultrasonic treatment.

It is still further preferred that, in the image formation method mentioned above, the mother toner particle has an average circularity of from 0.910 to 0.970.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
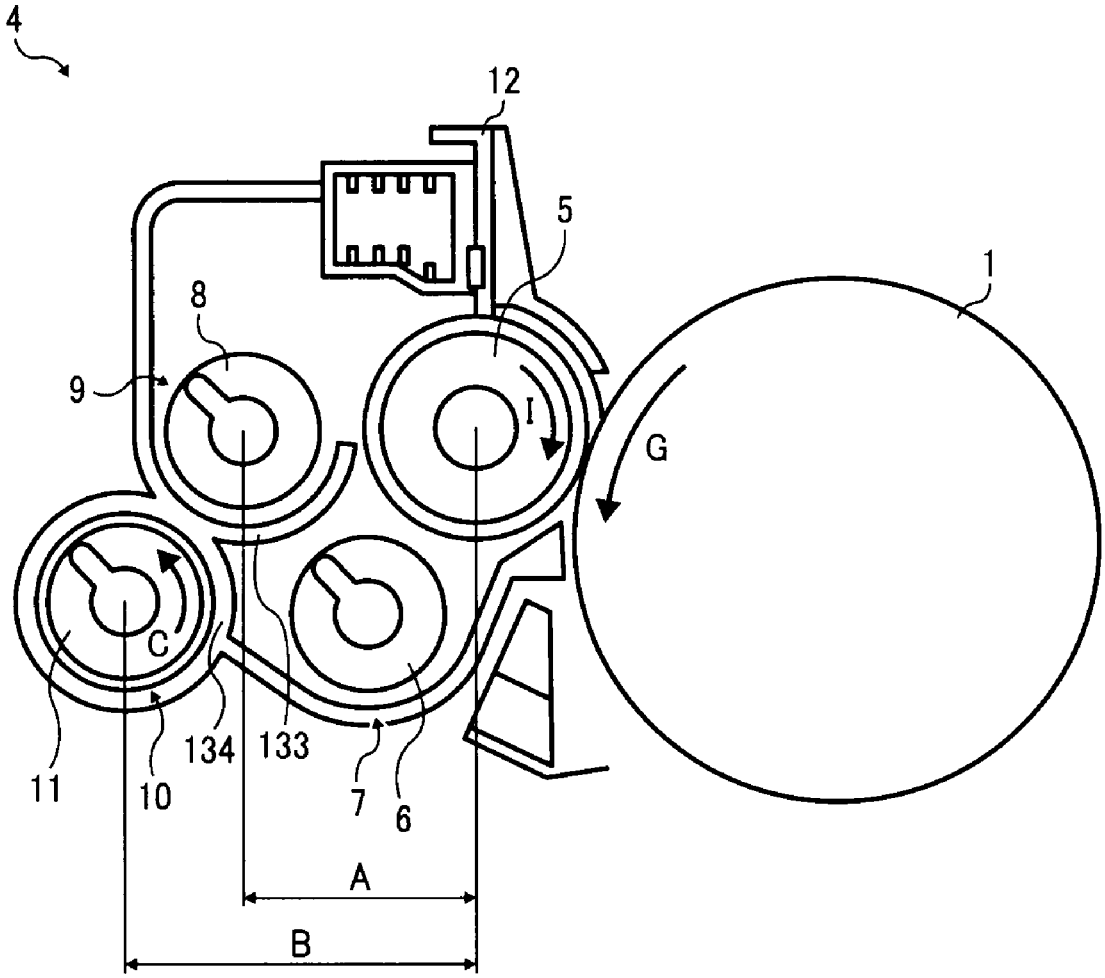
FIG. 1 is a diagram illustrating an example of the development device of the present invention.

The present invention will be described below in detail with reference to several embodiments.

The present inventors have found that, by controlling the fluidity of mother toner particles before inorganic particulates are attached thereto and the fluidity of toner particles to which inorganic particulates are attached and which have been preserved in a particular environment for a certain period of time, an image forming apparatus for a super high speed performance using a two component developing agent can stably output quality images over an extended period of time even under a mechanical and process condition significantly different from the case in which an image forming for a low or middle speed range is used in terms of the abrasion damage to the developing agent in the development device and the temperature environment in the image forming apparatus. That is, specifically, an image forming apparatus using the toner satisfying the following relationships (III) can stably produce quality images for an extended period of time:

$$Y \leqq -0.5X+45$$

$$5 \leqq X \leqq 40$$

$$5 \leqq Y \leqq 35 \qquad \text{Relationship (III)}$$

In the relationship (III), X (%) represents the degree of agglomeration of the mother toner particle and Y (%) represents the degree of agglomeration of the toner which has been preserved at 55° C. for 24 hours.

When the difference between the degree of agglomeration of mother toner particles and the degree of agglomeration of toner containing an external additive preserved at 55° C. for 24 hours is excessively small, the fluidity of the toner tends to be good so that the development sleeve rotating at a high speed cannot hold some of the toner particles, which results in scattering and contamination in an apparatus. To the contrary, when the degree of agglomeration of mother toner particles and the degree of agglomeration of toner containing an external additive preserved at 55° C. for 24 hours are excessively different, the fluidity of the toner tends to be bad so that the retention time of the toner in a development device is long. Thus, the toner particles have more chances of agglomeration. Such agglomerated toner particles pass through a charging member as they are. Alternatively, such toner agglomeration body is fused and attached to a charging member and remains on an image bearing member, which causes whiteout.

In addition, a Y that is excessively great also causes whiteout.

Furthermore, by increasing the attachment force of an inorganic particulate to the surface of a mother toner particle, quality images can be securely obtained for an extended period of time.

The attachment ratio of an inorganic particulate functioning as an external additive to the surface of mother toner particles for use in the present invention is preferably from 65 to 95% and more preferably from 80 to 95%. When the attachment ratio is too small, the inorganic particulate tends to be detached from the surface of a mother toner particle while the toner is used for a long time. Consequently, the surface state of the toner particle tends to be close to that of a mother toner particle, meaning that such toner particles easily agglomerate. To the contrary, an attachment ratio that is too small actually means that the inorganic particulate is embedded in a mother toner particle although it is not completely buried therein. The toner particles also easily agglomerate in this case, thereby causing whiteout.

The average circularity of the mother toner particle for use in the present invention is preferably from 0.910 to 0.970 and more preferably from 0.920 to 0.960. When the average circularity is too small, the chance of contact between an external additive and a carrier particle, etc. tends to be small so that the contact point is limited and the entire amount of charge is small. In addition, the transfer property also deteriorates, which causes deterioration of the image quality due to transfer remaining. To the contrary, when the average circularity is too large, although the transfer property is improved the chance of contact between an external additive and a carrier particle, etc. tends to be large so that the external additive is detached or embedded in a mother toner particle over time. This causes whiteout as described above.

The image formation method of the present invention includes a process of: applying a voltage to a charging device and charging a charged member (an image bearing member); irradiating the charged member with light for forming a latent electrostatic image thereon; developing the latent electrostatic image with a developing agent (toner) by a development device to form a toner image on the charged member; transferring the toner image on the charged member directly or via an intermediate transfer body to a transfer material; and fixing the toner image on the transfer material upon application of heat. In the development process, a stirring and transfer device is provided to transfer the developing agent to the development device while stirring the developing agent. The stirring and transfer device satisfies the following relationship (I): $1.0\times10^6 \leqq \alpha\times\beta\times\gamma \leqq 16.0\times10^6$. In the relationship, $\alpha$ represents the number of rotation per minute, $\beta$ (mm) represents the pitch and $\gamma$ (mm) represents the transfer path length of the stirring and transfer device. It is preferred that $\alpha$ is from 400 to 800, $\beta$ is from 5 to 20 and $\gamma$ is from 500 to 1,000. When the value of $\alpha\times\beta\times\gamma$ is too small, the amount of charge for a developing agent tends to be insufficient when images having a high image area ratio are continuously printed for a long time. To the contrary, when the value of $\alpha\times\beta\times\gamma$ is too large, the retention time of a developing agent tends to be long so that the toner particles have more chances of agglomeration, which leads to production of abnormal images having whiteout.

FIG. 1 is a diagram illustrating a development device 4. The development device 4 includes a development roller 5 as a developing agent bearing member and supplies toner to a latent electrostatic image on the surface of an image bearing member 1 while the surface of the development device 4 moves in the direction indicated by an arrow in FIG. 1. In addition, the development device 4 includes a supply screw 8 as a developing agent supply and transfer member for transferring the developing agent from the front direction to the back direction relative to FIG. 1.

On the downstream side relative to the surface transfer direction from the facing portion of the development roller 5 to the supply screw 8, a development doctor blade 12 is provided as a developing agent layer regulating member for suitably regulating the thickness of the developing agent supplied to the development roller 5 for development.

On the downstream side relative to the surface transfer direction based on the development portion of the development roller 5 facing the image bearing member 1, a retrieval screw 6 is provided as a developing agent retrieval transfer member for retrieving the developing agent that has passed the development portion and transferring the retrieved developing agent in the same direction as the supply screw 8 does. A supply and transfer path 9 as a developing agent supply and transfer path having the supply screw 8 is provided laterally relative to the development roller 5 and a retrieval and transfer path 7 as a developing agent retrieval and transfer path having the retrieval screw 6 is provided below the development roller 5.

The development device 4 has a stirring and transfer path 10 as a developing agent stirring and transfer path below the supply and transfer path 9 and in parallel with the retrieval and transfer path 7. The stirring and transfer path 10 has a stirring screw 11 as a developing agent stirring and transfer member for stirring and transferring the developing agent from the back direction to the front direction relative to FIG. 1, which is the opposite direction to the case of the supply screw 8.

The supply and transfer path 9 and the stirring and transfer path 10 are divided by a first wall separator 133 as a separation member. The portion of the first wall separator where the supply and transfer path 9 and the stirring and the transfer path 10 are divided has an opening at the front end and the back end relative to FIG. 1. Thus, the supply and transfer 9 and the stirring and transfer 10 are in communicated with each other.

The supply and transfer 9 and the retrieval and transfer 7 are also divided by the first separation member 133 but there is no opening provided on the portion of the first wall separator 133 where the supply and transfer 9 and the retrieval and transfer 7 are divided.

The two transfer paths of the stirring and transfer path 10 and the retrieval and transfer path 7 are divided by a second wall separator 134. The second wall separator 134 has an opening at the front end relative to FIG. 1 and the stirring and transfer path 10 is communicated with the retrieval and transfer path 7.

The supply screw 8, the retrieval screw 6 and the stirring screw 11 as the developing agent transfer members are formed of resins. The diameter of each screw is 18 mm Φ, the screw pitch thereof is 25 mm and the rotation number thereof is set to be about 600 rpm.

The developing agent that has been regulated by the development doctor blade 12 which is formed of stainless steel is transferred for development on the development roller 5 to the development portion facing the image bearing member 1. The surface of the development roller 5 is V-groove or sand blast treated. The development roller 5 is made of aluminum tube having a diameter of 25 mm. The gap between the development doctor blade 12 and the image bearing member 1 is about 0.3 mm.

The developing agent on the development roller after development is retrieved at the retrieval and transfer path 7 and transferred to the front direction of the cross section of FIG. 1. Then, at the opening of the first wall separator 133 provided to the non-image development area, the developing agent is transferred to the stirring and transfer path 10. Toner is supplied from a toner supply mouth provided above the stirring and transfer path 10 and around the opening of the first wall separator 133 on the upstream side relative to the developing agent transfer direction of the stirring and transfer path 10, to the stirring and transfer path 10.

Next, the circulation of the developing agent in the three developing agent transfer paths is described.

Figure 2:
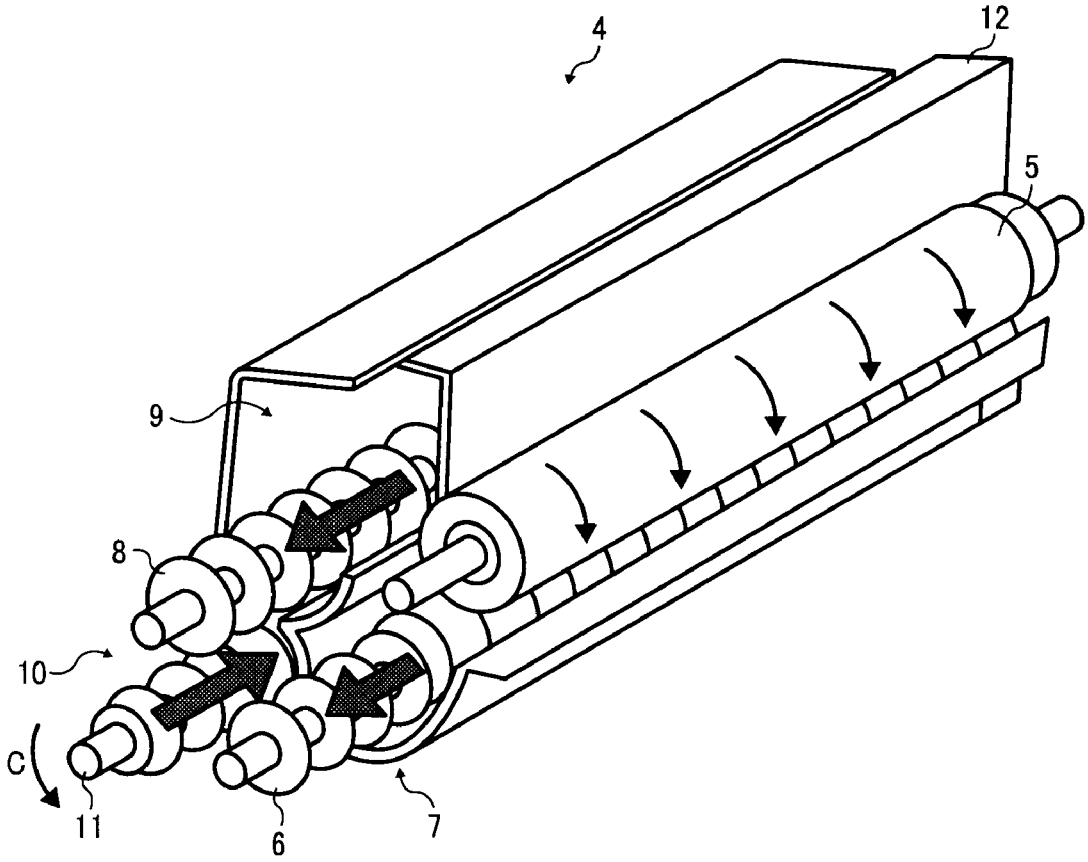
FIG. 2 is a perspective cross section illustrating an example of the development device of the present invention.

FIG. 2 is a perspective cross section of the development device 4. The flow of the developing agent in the development device 4 is described with reference to FIG. 2. Each arrow in FIG. 2 indicates the transfer direction of the developing agent.

Figure 3:
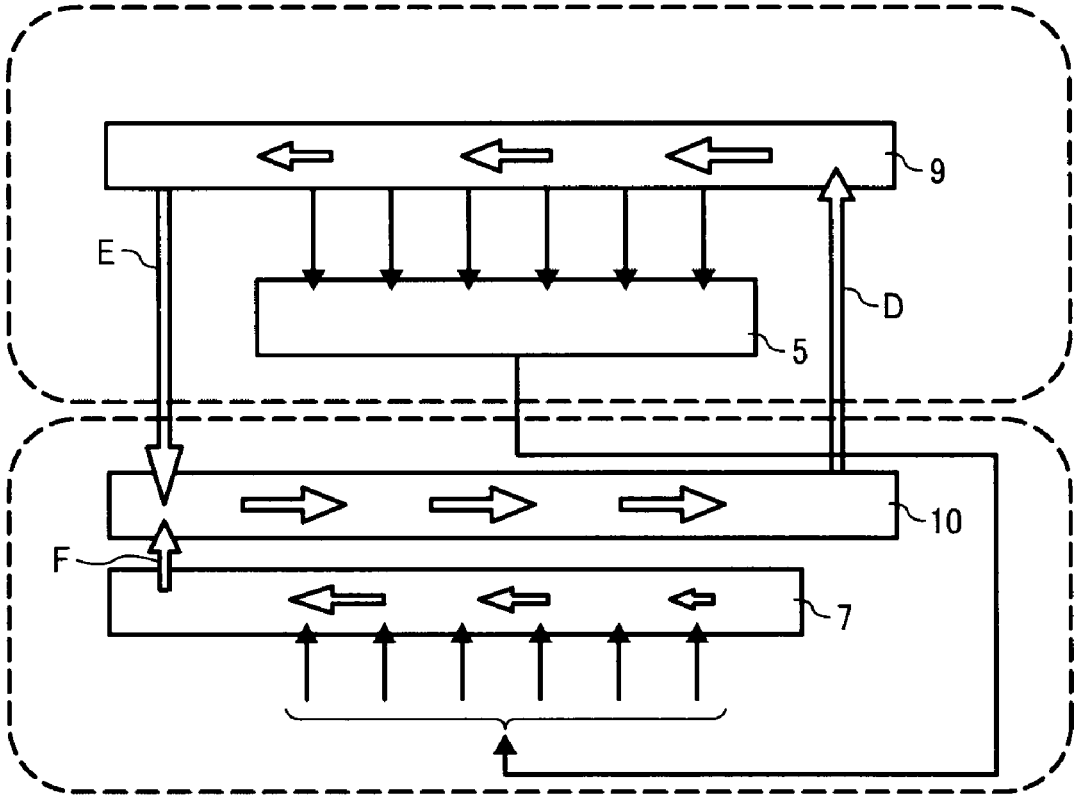
FIG. 3 is a schematic diagram illustrating the flow of a developing agent in an example of the development device of the present invention.

In addition, FIG. 3 is a schematic view illustrating the flow of the developing agent in the development device 4 and each arrow in FIG. 3 indicates the transfer direction of the developing agent as in FIG. 2.

The supply and transfer path 9, to which the developing agent is supplied from the stirring and transfer path 10, supplies the developing agent to the development roller 5 and on the downstream side relative to the transfer direction of the supply screw 8. The developing agent supplied to the development roller 5 but not used for development and transferred to the downstream end of the transfer direction of the supply screw 9, which is extra developing agent, is supplied from the opening of the first wall separator 133 to the stirring and transfer path 10 (indicated by an arrow E).

The developing agent transferred from the development roller 5 to the retrieval and transfer path 7 and transferred to the downstream end relative to the transfer direction in the retrieval and transfer path 7, which is retrieved developing agent, is supplied to the stirring and transfer path 10 from the opening of the second wall separator 134 (indicated by an arrow F).

The extra developing agent and the retrieved developing agent are stirred in the stirring and transfer path 10, transferred to the downstream side of the stirring screw 11 relative to the transfer direction and the upstream side of the supply screw 8 relative to the transfer direction and supplied to the supply and transfer path 9 through the opening of the first wall separator 133 (indicated by an arrow D).

In the stirring and transfer path 10, the extra developing agent, the retrieved developing agent and toner replenished on a necessity basis in the transfer portion are stirred and transferred by the stirring screw 11 in the direction opposite to the direction of the developing agent transferred in the retrieval and transfer path 7 and the supply and the transfer path 9. The stirred developing agent is transferred to the upstream side relative to the transfer direction of the supply and the transfer path 9 communicated in the downstream side relative to the transfer direction. In addition, below the stirring and transfer path 10, a toner density sensor (not shown) is provided and operates a toner replenishment control device for replenishing toner from a toner container (not shown) by a sensor output (not shown).

Next, the flow of the developing agent is described with reference to FIGS. 1 to 3 as follows.

In a high speed image forming apparatus as described in the present application, the temperature inside the image forming apparatus, especially the temperature inside the development device, easily rises. Thus, toner in a developing agent tends to melt during stirring and transfer of the developing agent, which causes toner to form agglomeration body and results in production of an abnormal images having whiteout.

In the present invention, Tin (° C.) satisfies the following relationship (II): 30° C.<Tin<60° C. Tin (° C.) represents the inner temperature in the stirring and transfer process (device) in the development device 4 illustrated in FIG. 1 or FIG. 2.

The stirring and transferring device for use in the stirring and transfer process represents the retrieval screw 6, the supply screw 8 and the stirring screw 11 (i.e., excluding a development roller 5). Each screw has the same rotation number $\alpha$ (rotation/minute) and the same pitch $\beta$ (mm). The transfer path length $\gamma$ (mm) represents the transfer path length of the stirring and transfer device as described above and specifically the sum of the lengths of the retrieval and transfer path 7, the supply and transfer path 9 and the stirring and transfer path 10 as described above.

The temperature Tin (° C.) in the stirring and transfer process represents the temperature inside the development device 4 of FIGS. 1 and 2.

When Tin (° C.) satisfies the relationship, it is possible to restrain production of abnormal images with whiteout. When Tin (° C.) is excessively high, whiteout is caused by agglomeration of toner and the developing agent entirely is solidified so that no image can be output. When Tin (° C.) is excessively low, agglomeration body is not formed but a new problem arises such that the image density is insufficient since the electrostatic force between the toner and the carrier is too strong. Therefore, with regard to a high speed image forming apparatus as described in the present invention, it is good that the temperature Tin (° C.) in the development device during image formation (i.e., stirring and transferring developing agents in the development device) satisfies the relationship of 30° C.<Tin<60° C.

As the binder resin for use in the present invention, a polyol resin is used in light of high gloss, excellent color development and a wide range of fixing temperature for a full color image. As the polyol resin, it is suitable to use a polyol resin in which the end of an epoxy resin is capped and the main chain has a polyoxyalkylene portion in consideration of charging stability in environment, fixing stability, gloss stability, prevention of curling after fixing. For example, such a polyol resin can be prepared by conducting a reaction of an epoxy resin having a glycidyl group at its both ends and an adduct of diphenol having a glycidyl group at its both ends with alkylene oxide with dihalide, isocyanate, diamine, diol, polyphenol, and dicarboxylic acid. It is most preferred to conduct a reaction of diphenol in light of reaction stability. In addition, it is suitable to use a polyphenol and/or polycarboxylic acid in combination with a diphenol while preventing gelatification.

The polyol resin for use in the present invention preferably has a molecular chain in which the ratio (EX/OH) of epoxy resin (EX) to hydroxyl group (OH) is from 0.990 to 1.010. When the ratio is too small, there are quite a number of hydroxyl groups in a molecular chain so that such a polyol resin tends to absorb moisture in a high humidity environment. That is, toner particles easily agglomerate in a development device, thereby causing production of abnormal images having whiteout, etc. To the contrary, when the ratio is too small, the reaction is unstable and the polyol resin does not function properly.

The ratio (EX/Oh) of epoxy resin (EX) to hydroxyl group (OH) can be obtained as follows according to Formula (I):

$$(B1/NB1+B2/NB2)/(A1/2NA+A2/NA+C/NC+E/NE) \quad \text{Formula (I)}$$

A1: Weight of bisphenol for use in endcapping the molecule

A2: Weight of bisphenol for use in elongating the main chain of the molecule

NA: Active hydrogen equivalent amount of bisphenol

B1: Weight of bisphenol type epoxy resin having a low molecular weight

NB1: Epoxy equivalent amount of bisphenol type epoxy resin having a low molecular weight B2: Weight of bisphenol type epoxy resin having a high molecular weight NB2: Epoxy equivalent amount of bisphenol type epoxy resin having a high molecular weight C: Weight of polyol NC: Active hydrogen equivalent amount of polyol E: Weight of cross linking agent NE: Active hydrogen equivalent amount and epoxy equivalent amount of cross linking agent Epoxy Equivalent Amount Epoxy equivalent amount is calculated as follows:

Precisely weigh 0.2 to 5 g of a resin sample and place the resin sample in a flask: Dissolve the resin sample by adding 25 ml of dioxane thereto: Add 25 ml of 0.2 mol/l of hydrochloric solution (dioxane solvent) to the solution; Subsequent to sufficient mixing while tightly stoppered, the solution is left for 30 minutes: Add 50 ml of toluene-ethanol liquid mixture (toluene/ethanol=1/1 in volume ratio); Titrate the liquid mixture by 0.1 mol/l of sodium hydroxide aqueous solution using cresol red as the indicator; Conduct a blank experiment in the same manner; According to the titration result, calculate the epoxy equivalent amount (g/equivalent ratio) using the following relationship:

$$\text{Epoxy equivalent amount (g/equivalent amount)}=1{,}000\times W[(B-S)\times N\times F]$$

W: Weight of sample (g)

B: Amount (ml) of sodium hydroxide aqueous solution required for blank experiment S: Amount (ml) of sodium hydroxide aqueous solution required for titration N: Density (mol/l) of sodium hydroxide aqueous solution F: Value of the force of sodium hydroxide aqueous solution Suitable colorants (coloring material) for use in the present invention include any known dyes and pigments. Specific examples of yellow colorants include, but are not limited to, Naphthol Yellow S, Hansa Yellow (10G, 5G and G), Cadmium Yellow, yellow iron oxide, loess, chrome yellow, Titan Yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, and isoindolinone yellow. Specific examples of magenta colorants include, but are not limited to, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, Chrome Vermilion, Benzidine Orange, perynone orange, and Oil Orange. Specific examples of cyan colorants include, but are not limited to, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian emerald green, Pigment Green B, Naphthol Green B, Green Gold, Acid Green Lake, Malachite Green Lake, Phthalocyanine Green, Anthraquinone Green, titanium oxide, zinc oxide, and lithopone. Specific examples of black colorants include, but are not limited to, carbon black, Nigrosine dyes, and black iron oxide. A specific example of complementary color colorants includes, but are not limited to, a cyan-based pigment. These materials can be used alone or in combination. The content of each color is typically from 0.1 to 50 parts by weight based on 100 parts by weight of a binder resin.

A charge control agent may be included as a component of the toner for use in the present invention.

Specific examples of the charge control agent include known charge control agents, for example, Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphorous and compounds including phosphorous, tungsten and compounds including tungsten, fluorine-containing activators, metal salts of salicylic acid, metal salts of salicylic acid derivatives, etc. The content of the charge control agent is determined depending on the method of manufacturing toner in relation to the kind and the content of a binder resin and an additive, and therefore is not simply specified. However, the content of the charge control agent is preferably from 0.1 to 10 parts by weight, and more preferably from 0.5 to 3 parts by weight based on 100 parts by weight of the binder resin. When the content is too small, toner is not negatively charged sufficiently, which is not suitable for a practical use. When the content is excessively large, the chargeability of toner tends to increase, which may lead to reduction of image density due to spent or filming caused by increase in electrostatic attraction force with carriers and a development sleeve. These charge control agents can be used alone or in combination. Also, it is possible to change the addition amount thereof depending on the sequence of each color toner development.

The toner for use in the present invention can contain a wax, if desired. It is suitable to use a wax having a melting point of from 40 to 120° C. and preferably from 50 to 110° C. When the melting point of a wax is too high, the low temperature fixing property of a toner may be insufficient. When the melting point of a wax is too low, the anti-offset property and the durability of a toner may deteriorate. The melting point of a wax can be measured by a differential scanning calorimeter (DSC). That is, the melting peak value obtained when several grams of a sample are heated at a constant temperature rise speed, for example 10° C./min, is determined as the melting point. Specific examples of such wax include, but are not limited to, solid paraffin wax, micro wax, rice wax, aliphatic amide based wax, aliphatic acid based wax, aliphatic monoketones, aliphatic metal salt based wax, aliphatic ester based wax, partially saponified aliphatic ester based wax, silicone wax, higher alcohol and carnauba wax. Polyolefins such as a low molecular weight polyethylene and a polypropylene can be also used. Especially, a polyolefin having a softening point of from 70 to 150° C. measured by a ring and ball method is preferred and, a softening point of from 120 to 150° C., more preferred.

As the carrier for a two component developing agent, typical carriers, for example, iron powder, ferrite, magnetite and glass beads, can be used. These carriers can be coated with a resin. Specific examples of such resins include, but are not limited to, polycarbon fluorides, polyvinyl chlorides, polyvinylidene chloride, phenol resins, polyvinyl acetal, and silicone resins. With regard to the mixture ratio of toner to carrier, about 1.5 to about 10.0 parts by weight of toner to 100 parts by weight of carrier is suitable in any case.

As the external additive for use in the present invention, inorganic particulates such as metal oxides, metal carbides, metal nitrides, metal carbonates are used. Specific preferred examples of such inorganic particulates include, but are not limited to, silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride.

Furthermore, organic particulates can be used as an external additive. For example, polymeric particulates can be used. Specific examples thereof include, but are not limited to, copolymers of styrene, esters of methacryic acid, and esters of acrylic acid, which can be prepared by a soap-free emulsion polymerization method, a suspension polymerization method or a dispersion polymerization method, and polycondensation thermosetting resins, for example, silicone resins, benzoguanamine resins and nylon. Such external additives can be subject to a surface treatment to improve hydrophobic property, thereby preventing deterioration of the fluidity and charging properties of a toner even in a high humidity environment. Specific preferred examples of the surface treatment agents include, but are not limited to, coupling agents such as silane coupling agents, titanate coupling agents and aluminum coupling agents; silicone oil; higher aliphatic acids; and fluorine compounds.

Especially, silane coupling agents as an example of the coupling agents are used to improve hydrophobic property and fluidity. Specific examples of the silane coupling agents include, but are not limited to, chlorosilane, alkoxy silane, silazane, and special sililating agents. Among these, alkoxy silanes are preferred. Specific examples of such alkoxy silanes include, but are not limited to, vinyl trimethoxy silane, propyl trimethoxy silane, i-butyl trimethoxy silane, n-butyl trimethoxy silane, n-hexyl trimethoxy silane, n-octyl trimethoxy silane and n-dodecyl trimethoxy silane.

Specific examples of such silicone oil include, but are not limited to, polydiemethyl siloxane, polymethylphenyl siloxane and polydiphenyl siloxane. Siloxanes containing fluorine can be also used.

Specific examples of fluorine compounds include, but are not limited to, 3,3,4,4,5,5,6,6,6-nonafluorohexyl trichloro silane, 3,3,3-trifluoropropyl trimethoxy silane, methyl-3,3,3-trifluoropropyl dichloro silane, dimethoxymethyl-3,3,3-trifluoro propyl silane, and 3,3,4,4,5,5,6,6,6-nonafluorohexylmethyl dichloro silane.

Specific examples of such higher aliphatic acids include, but are not limited to, stearyic acid, oleic acid, palmitic acid, and linoleic acid and metal salts thereof can be also used. Specific examples thereof include, but are not limited to, zinc stearate, aluminum stearate, copper stearate, magnesium stearate, calcium stearate, zinc oleate, manganese oleate, zinc palmitate, zinc linoleate, and calcium linoleate In addition, the average primary particle diameter of the external additives for use in the present invention is preferably from 0.005 to 0.03 μm and more preferably from 0.01 to 0.02 μm. When the average primary particle diameter is too small, the external additive roils and is attached to the wall of a mixer when mother toner particles and the external additive are mixed so that the external additive is not sufficiently attached to the surface of a mother toner particle, which leads to insufficient fluidity. To the contrary, when the average primary particle diameter is too large, it is desired to increase the prescription amount of the external additive to secure the fluidity and the leak point of an external additive having a small particle diameter, which causes drawbacks such as carrier spent.

Next, the method of manufacturing toner is described.

The toner for use in the present invention is manufactured by processes of: mechanically mixing a toner composition containing at least a binder resin, a coloring agent (colorant), and a charge control agent; melting and kneading the mixture; pulverizing the resultant; and classifying the resultant, in this sequence. In the mechanical mixing process mentioned above, the component having a particle diameter outside that of a toner product obtained in the pulverization and/or classification process is retuned thereto and can be mechanically mixed again. Returning the component having a particle diameter outside that of a toner product is optional. When the component having a particle diameter outside that of a toner product is returned to the mechanical mixing process for toner manufacturing, the content of the returned component having a particle diameter outside that of a toner product is preferably from 5 to 40 parts by weight and more preferably from 10 to 35 parts by weight based on 100 parts by weight of the toner composition. When the component having a particle diameter outside that of a toner product is subject to mixing and kneading twice, the component having a particle diameter outside that of a toner product tends to be relatively brittle, meaning that the pulverization property is improved. Therefore, when the content of the component having a particle diameter outside that of a toner product is too small, for example, 5 parts by weight, this improvement effect is relatively weak. To the contrary, a content that is excessively large causes a problem with regard to the preservabitliy and durability.

In the method of manufacturing toner for use in the present invention, there is no specific limit to the process of mechanically mixing the toner composition containing at least a binder resin, a coloring agent (colorant) and a charge control agent and the component having a particle diameter outside that of a toner product. For example, a typical mixing device having a rotation blade can be used under normal conditions therefor.

When the mixing process is complete, the mixture is placed in a kneading device for melting and kneading. As a melting and kneading device, there can be used a one-axis or two-axis continuous type melting and kneading device or a batch type melting and kneading device by a roll mill. This melting and kneading is performed under a condition in which the molecule chain of a binder resin is not severed. Specifically, it is preferred to melt and knead the mixture in the range of from 40 to 65° C. When the temperature is too low, the molecular chain is easily severed excessively. When the temperature is too high, dispersion does not easily progress.

Subsequent to the melting and kneading process mentioned above, the kneaded material is pulverized. In this pulverization process, it is preferred that the kneaded material is coarsely pulverized first followed by fine pulverization. As the pulverization method, there can be preferably used a method in which the material collides with a collision board in a jet air or a method in which the material is pulverized in a narrow gap formed between a mechanical rotating rotor and a stator. After the pulverization process, the pulverized material is classified by a centrifugal in an air stream to obtain mother toner particles having a particular particle diameter, for example, a weight average particle diameter of from 5 to 12 μm. A toner is preferred which has a weight average particle diameter of from 5 to 9 μm with toner particles having a sharp particle size distribution while containing a particle diameter of not greater than 4 μm in an amount of not greater than 10% by number. The component having a particle diameter outside that of a toner product obtained in the pulverization process and/or the classification process is optionally returned to the mixing process for reuse.

With the mother toner particles obtained through these processes, inorganic particulates mentioned above such as the hydrophobic silica and hydrophobic titanium oxide are admixed. A typical powder mixing device is used for mixing such an external additive. It is preferred to use a jacket, etc. to control the temperature inside the device. To change the attachment ratio (strength of attachment) of an external additive to the surface of a mother toner particle, it is good to add the external additive little by little or in the middle of the process. Another method is, for example, changing the number of rotation of a mixing device and/or the conditions such as time and temperature. Specifically, it is possible to apply heavy load first and then a relatively weak load to the mixture or vice versa. Specific examples of such mixing devices include, but are not limited to, a V type mixing device, a rocking mixing device, a LOEDIGE MIXER, a NAUTER MIXER and a HENSCHEL MIXER.

Agglomeration Degree of Mother Toner Particle and Toner

The agglomeration degree of the mother toner particle and the toner including external additives is measured when preserved in the environment of the temperature of 55° C. for 24 hours. The agglomeration degree is measured according to the following procedure (The measuring device used is a powder tester manufactured by Hosokawa Micron Corporation):

The accessories are set on the vibration board of the measuring device in the following order:

(i) vibroshoot (ii) packing (iii) space ring (iv) 3 screens having different openings: the size of the openings thereof becomes smaller in the order of the upper screen, middle screen and lower screen (v) fastening bar Then, the vibration board is fastened with a knob nut and then vibrated. The measuring conditions are as follows:

Opening of the upper screen: 75 μm

Opening of the middle screen: 45 μm

Opening of the lower screen: 22 μm

Scale range: 1 mm

The amount of developer sample: 2 g

Vibration time: 15 seconds.

After this measurement, the agglomeration degree is determined by the following calculations.

The agglomeration degree (%)=a+b+c, wherein a=(A/D)×100, b=(B/D)×100×3/5 and c=(C/D)×1/5, wherein A represents the amount of the powder sample remaining on the upper screen, B represents the amount of the powder sample remaining on the middle screen, C represents the amount of the powder sample remaining on the lower screen and D represents the amount of the powder sample.

Attachment Ratio of External Additive

The attachment ratio of an external additive to the surface of a mother toner particle is measured as follows: Wet and dip 5 g of a toner to which an external additive is attached in 100 ml of an aqueous solution of a surface active agent of 0.2% by weight; Dip a ultrasonic vibrator of a ultrasonic type homogenizer (UH-30, manufactured by Ultrasonic Engineering Co., Ltd.) in the liquid dispersion and ultrasonic-vibrate the vibrator with a resonance frequency of 25 KHz for 1 minute to detach inorganic particulates from the surface of the mother toner particle; Wash, suction-filter and dry the liquid dispersion; Weigh 3.0 to 3.1 g of the dried toner; Apply a load of 6 t/cm$^2$ to the dried toner for one minute to mold the toner into a disk form having a diameter of 40 mm with a thickness of from 2.2 to 2.5 mm; and determine quantity of the inorganic particulates remaining on the surface of a toner particle by a fluorescent X ray analysis method.

There are various kinds of methods for determining quantity of the inorganic particulates remaining on the surface of a toner particle although a fluorescent X ray analysis is a typical method. In this method, an analytical curve is made for a toner to which an already known amount of an inorganic particulate is attached and the amount of remaining inorganic particulates is determined by the analytical curve method. For example, quantity determination is performed as follows: Press and mold a sample of 32 mm Φ into an aluminum ring for quantity determination measurement using a fluorescent X ray analysis device (RIX3000, manufactured by Rigaku Corporation) under the following condition:

Spectroscopic crystal: LiFl

Power: 50 KV

Current: 50 mA

Target: Rh

Measuring range: 30 mm Φ:

This quantity is represented by $M_1$; Press and mold a toner which has not been subject to the supersonic treatment mentioned above: and determine quantity of the inorganic particulates existing on the surface of the toner particle by the fluorescent X ray analysis: This quantity is represented by $M_0$.

The attachment of the external additive is obtained by the following relationship:

$$\text{Attachment ratio of external additive}=(M_1/M_0)\times 100\ (\%)$$

Average Circularity of Mother Toner Particle

The average circularity of mother toner particles is an average circularity measured by using an image analysis method. It is preferred to use a flow type particle image analyzer (FPIA-2100, manufactured by Sysmex Corporation) for measurement.

The analyzer FPIA-2100 calculates the circularity of each particle and classifies each particle into 61 division classes from a circularity of 0.4 to 1.0. Thereafter, the average circularity is calculated using a method (division method) in which the center value of each class and frequency (number of particles) are used. The error of the value of the average circularity calculated by this method to the value of the average circularity calculated by using a calculation method (sum method) in which the sum of the circularity of respective particles is used is small and ignorable in practical level. With regard to the calculation of the average circularity of the mother toner particle for use in the present invention, the sum method can be used and also the division method can be selected in terms of data processing procedure such as calculation in a short time and simplification of calculation formula. Furthermore, since the sheath flow is thin-layered (from 7 to 4 μm), the magnification power of processed particle images is improved, and the processing definition for the taken image is also improved (from 256×256 to 512×512), the analyzer FPIA-2100 for use in measuring the average circularity of the mother toner particle for use in the present invention is more accurate in measuring the form of toner particles than FPIA1000, which has been typically used. Therefore, in the calculation of the average circularity of mother toner particles, it is preferred to use FPIA-2100 because FPIA-2100 can provide more accurate information on the form and the particle size distribution thereof. For example, the form of toner particles is measured as follows: Analyze toner particles in an environment of 23° C. and 60% RH with the analyzer mentioned above; Analyze projection images of the particles having a circle equivalent diameter of 0.60 to 400 μm and measure the circumference L thereof; Calculate the circularity of the particle according to the following formula (β) based on the circumference L; Calculate the sum of circularity and the number of the particles having a circle equivalent diameter of from 3 to 400 μm; and determine the value obtained by dividing the sum of the circularity by the number of the particles as the average circularity.

$$\text{Circularity}=L_0/L \qquad \text{Formula } (\beta)$$

In the formula, $L_0$ represents the circumference of a circle having the area equivalent to the projection area of a particle image and L represents the circumference of the projection image of a particle when image-processed with an image processing definition (pixel of 0.3 μm×0.3 μm) of 512×512.

The detailed procedure is as follows: Add 0.1 to 0.5 ml of a surface active agent (preferably alkylbenzene sulfonate) in 200 to 300 ml of water from which impurities are removed; Add about 0.1 to 0.5 g of a measuring sample thereto; Disperse the suspension in which the sample is dispersed by a ultrasonic oscillator for 2 minutes to make the density of the liquid dispersion to be from 2,000 to 10,000 particles/μl. For example, the following device is used as the ultrasonic oscillator under the following dispersion condition: UH-150 (manufactured by SMT Co., Ltd.)

Output level: 5
Constant Mode:

The average circularity of the particles of the liquid dispersion prepared as described above is measured. The measurement and calculation thereof are briefly described as follows: Pass a sample liquid dispersion through the flow channel (wider along the flow direction) of a flat flow cell (thickness: about 200 μm); Place a strobe lamp and a CCD camera at opposite positions to each other relative to the flat flow cell to form a light path intersecting and passing the flow cell in a crossing manner relative to the thickness of the flat flow cell; Irradiate the sample liquid dispersion with strobe light at an interval of 1/30 seconds to obtain images of particles dispersing in the sample liquid dispersion and as a result the image of each particle is taken as a two-dimensional image having a certain range parallel to the flat flow cell; Calculate the diameter of a circle having the same area as that of a particle as the circle equivalent diameter thereof; Calculate the circularity of each particle from the projection area and the circumference of the two dimension image of each particle according to Formula (β); and obtain the average circularity as described above.

Having generally described preferred embodiments of this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

The present invention is specifically described in detail with reference to Manufacturing Examples and Examples.

Synthesis Examples of Polyol Resin

Synthesis Example 1

Place the following recipe in a flask equipped with a stirrer, a thermometer, a nitrogen introduction mouth and a condenser; Raise the temperature to 70 to 100° C. in nitrogen atmosphere: Add 0.183 g of lithium chloride; Raise the temperature to 160° C.; Remove xylene under a reduced pressure; and polymerize the resultant at a reaction temperature of 180° C. for 6 to 9 hours.

| | |
|---|---|
| Epoxy resin of low molecular weight bisphenol A type (number average molecular weight: about 1,000) | 1,000 g |
| Terephtahlic acid | 50 g |
| Benzoic acid | 10 g |
| Xylene | 300 g |

A polyol resin (Resin 1) having a softening point of 108° C. and a glass transition temperature of 61° C. is thus obtained in an amount of about 1 Kg. The ratio (EX/OH) of epoxy group (EX) to hydroxyl group (OH) is 0.995.

Synthesis Example 2

Place the following recipe in the same equipment as in Synthesis Example 1; Raise the temperature to 70 to 100° C. in nitrogen atmosphere: Add 0.183 g of lithium chloride; Raise the temperature to 160° C.; Remove xylene under a reduced pressure; and polymerize the resultant at a reaction temperature of 180° C. for 6 to 9 hours.

| | |
|---|---|
| Epoxy resin of low molecular weight bisphenol A type (number average molecular weight: about 1,000) | 500 g |
| Epoxy resin of high molecular weight bisphenol A type (number average molecular weight: about 5,000) | 404 g |
| Bisphenol A | 103 g |
| p-cumyl phenol | 59 g |
| Xylene | 300 g |

A polyol resin (Resin 2) having a softening point of 109° C. and a glass transition temperature of 58° C. is thus obtained in an amount of about 1,000 g. The ratio (EX/OH) of epoxy group (EX) to hydroxyl group (OH) is 1.000.

Synthesis Example 3

Place the following recipe in the same equipment as in Synthesis Example 1; Raise the temperature to 70 to 100° C. in nitrogen atmosphere: Add 0.183 g of lithium chloride; Raise the temperature to 160° C.; Remove xylene under a reduced pressure; and polymerize the resultant at a reaction temperature of 180° C. for 6 to 9 hours.

| | |
|---|---|
| Epoxy resin of low molecular weight bisphenol A type (number average molecular weight: about 360) | 302 g |
| Epoxy resin of high molecular weight bisphenol A type (number average molecular weight: about 3,000) | 100 g |
| Diglycidylated compound of an adduct of bisphenol A with ethylene oxide (n + m in Chemical formula (1) illustrated below: about 5.9) | 336 g |

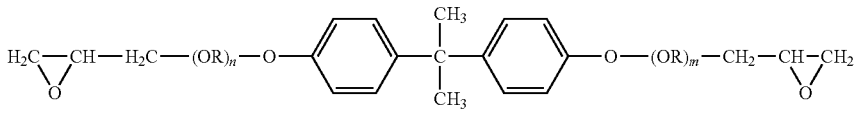

Chemical formula (1)

In Chemical formula (1), R represents —$CH_2CH_2$—, —$CH_2CHCH_3$— or —$CH_2CH_2CH_2$—.

| | |
|---|---|
| Bisphenol A | 210 g |
| p-cumyl phenol | 100 g |
| Xylene | 300 g |

A polyol resin (Resin 3) having a softening point of 109° C. and a glass transition temperature of 58° C. is thus obtained in an amount of about 1 kg. The ratio (EX/OH) of epoxy group (EX) to hydroxyl group (OH) is 1.005.

Synthesis Example 4

Place the following recipe in the same equipment as in Synthesis Example 1; Raise the temperature to 70 to 100° C. in nitrogen atmosphere: Add 0.183 g of lithium chloride; Raise the temperature to 160° C.; Remove xylene under a reduced pressure; and polymerize the resultant at a reaction temperature of 180° C. for 6 to 9 hours.

| | |
|---|---|
| Epoxy resin of low molecular weight bisphenol A type (number average molecular weight: about 680) | 390 g |
| Epoxy resin of high molecular weight bisphenol A type (number average molecular weight: about 6,500) | 403 g |
| Divalent acid of condensation of phthalic anhydride and an adduct of bisphenol A with propylene oxide | 199 g |
| Bisphenol A | 50 g |
| p-cumyl phenol | 51 g |
| Xylene | 300 g |

A polyol resin (Resin 4) having a softening point of 112° C. and a glass transition temperature of 59° C. is thus obtained in an amount of about 1 kg. The ratio (EX/OH) of epoxy group (EX) to hydroxyl group (OH) is 1.015.

Manufacturing Examples of Mother Toner Particle

Manufacturing Example 1

| Material Composition (toner material) | |
|---|---|
| Binder resin: Resin 1 | 100 parts |
| Coloring agent: Cyan pigment (copper phthalocyanine) | 5 parts |
| Charge control agent: BONTRON E-84 (manufactured by Orient Chemical industries Ltd.) | 2 parts |

Mix the toner material by a HENSCHEL MIXER (manufactured by Mitsui Miike Machinery Co., Ltd.); Mix and knead the mixture for 30 minutes by two rolls of which the temperature of the surface is set to be 60° C.; Subsequent to cool rolling and coarse powder pulverization, pulverize and air-classify the powder by a jet mill pulverizer (I-2 type mill, manufactured by Nippon Pneumatic Manufacturing Co., Ltd.) and a classifier using swirl flow (DS classifier, manufactured by Nippon Pneumatic Manufacturing Co., Ltd.) and thus a mother toner particle (Mother particle 1) is obtained. The agglomeration degree and the average circularity thereof are 36% and 0.925, respectively.

Manufacturing Examples 2 to 4

Mother toner particles (Mother particles 2 to 4) of Manufacturing Examples 2 to 4 are manufactured in the same manner as in Manufacturing Example 1 except that the binder resin 1 is changed to resin 2, 3 or 4, respectively. The agglomeration degree of Mother particles 2 to 4 are 21%, 39% and 32%, respectively. The average circularity of Mother particles 2 to 4 are 0.932, 0.928 and 0.936, respectively.

Manufacturing Example 5

Mother toner particle (Mother particle 5) of Manufacturing Example 5 is manufactured in the same manner as in Manufacturing Example 1 except that the binder resin 1 is changed to a polyester resin. The polyester resin is a resin prepared by polycondensing an adduct of bisphenol A with ethylene oxide, an adduct of bisphenol A with propylene oxide, terephthalic acid and phthalic acid with a molar ratio of 60:40:25:75 and has a softening point of 107° C. and a glass transition temperature of 59° C. The agglomeration degree and the average circularity of Mother particle 5 are 42% and 0.941, respectively.

Example 1

1.2 parts of hydrophobic silica (HDK 2000H, manufactured by Clariant Japan KK.) and 0.9 parts of titanium oxide (JMT-150IB, manufactured by Tayca Corporation) are added to 100 parts of Mother particle 1 as external additives followed by mixing by a HENSCHEL MIXER to obtain toner particles (Toner 1). The agglomeration degree of Toner 1 after preserved at 55° C. for 24 hours is 26%. The attachment ratio of hydrophobic silica and titanium oxide is 75% and 80%, respectively. The obtained toner is evaluated under the conditions of α, β, γ shown in Table 2.

Examples 2 to 6, Comparative Examples 1 to 7

Toners 2 to 13 are prepared in the same manner as in Example 1 except that mother toner particles shown in Table 1 and external additives are used. In Example 6, the perimeter speed of the rotation blade of the HENSCHEL MIXER is set to be 1.2 times as fast as that of Example 1 and, in Comparison Example 2, 0.8 times.

The following is used as the external additives.

Hydrophobic silica (HDK2000H, manufactured by Clariant Japan KK.)

Titanium oxide (JMT-150IB, manufactured by Tayca Corporation)

Titanium oxide (MT-150AI, manufactured by Tayca Corporation)

The obtained toners are evaluated under the conditions of α, β and γ shown in Table 2.

The characteristics of the resins for use in the toners of Examples and Comparative Examples are shown in Table 1.

TABLE 1

| | Softening point (° C.) | Glass transition temperature (° C.) | EX/OH | |
|---|---|---|---|---|
| Synthesis Example 1 | 108 | 61 | 0.995 | Resin 1 |
| Synthesis Example 2 | 109 | 58 | 1 | Resin 2 |
| Synthesis Example 3 | 109 | 58 | 1.005 | Resin 3 |
| Synthesis Example 4 | 112 | 59 | 1.015 | Resin 4 |
| Polyester | 107 | 59 | | |

Image Quality Evaluation (Room temperature environment)

A developing agent is prepared by uniformly mixing the toner of Examples and Comparative Examples with a ferrite carrier having an average particle diameter of 50 μm which is covered with a silicon resin with an average thickness of 0.3 μm in a ratio of 5 parts of the toner to 100 parts of the carrier using a Turblar mixer which stirs and charges toner and carrier by tumbling the container. The developing agent is set in a remodeled printer based on a digital full color multifunction machine (Imagio Neo C600, manufactured by Ricoh Co., Ltd.) and evaluated with regard to the following items: (1) Whiteout in the character portion; (2) Background fouling; and (3) Image density. The copy test is performed with a run length of 100,000 sheets in the full color mode.

For each evaluation item, the image chart having a 30% image area is evaluated after a continuous run length of 100,000 sheets.

Table 2 shows the characteristics and the process conditions of the toners of Examples 1 to 6 and Comparative Examples 1 to 7 for use in the image evaluation.

TABLE 2

| | Resin | Agglomeration degree X | Agglomeration degree Y | Whether Relationship (III) satisfied | Attachment ratio of silica | Attachment ratio of titanium oxide |
|---|---|---|---|---|---|---|
| Example 1 | Resin 1 | 36 | 26 | Yes | 75 | 80 |
| Example 2 | Resin 1 | 36 | 20 | Yes | 80 | 85 |
| Example 3 | Resin 2 | 21 | 32 | Yes | 70 | 75 |
| Example 4 | Resin 2 | 21 | 24 | Yes | 85 | 90 |
| Example 5 | Resin 3 | 39 | 22 | Yes | 80 | 80 |
| Example 6 | Resin 3 | 32 | 27 | Yes | 90 | 95 |
| Comparative Example 1 | Resin 3 | 39 | 42 | No | 65 | 80 |
| Comparative Example 2 | Resin 3 | 39 | 48 | No | 50 | 65 |
| Comparative Example 3 | Resin 4 | 32 | 29 | Yes | 75 | 80 |
| Comparative Example 4 | Resin 4 | 32 | 40 | No | 70 | 75 |
| Comparative Example 5 | PE | 42 | 38 | No | 80 | 90 |
| Comparative Example 6 | PE | 42 | 24 | Yes | 90 | 95 |
| Comparative Example 7 | Resin 1 | 36 | 27 | Yes | 90 | 90 |

| | Average circularity | α (rpm) | β (mm) | γ (mm) | α × β × γ | Tin (° C.) |
|---|---|---|---|---|---|---|
| Example 1 | 0.925 | 600 | 10 | 700 | $4.2 \times 10^6$ | 45 |
| Example 2 | 0.925 | 600 | 10 | 700 | $4.2 \times 10^6$ | 40 |
| Example 3 | 0.932 | 700 | 5 | 900 | $3.15 \times 10^6$ | 50 |
| Example 4 | 0.932 | 700 | 5 | 900 | $3.15 \times 10^6$ | 45 |
| Example 5 | 0.928 | 800 | 15 | 1000 | $12.0 \times 10^6$ | 45 |
| Example 6 | 0.936 | 800 | 15 | 1000 | $12.0 \times 10^6$ | 55 |
| Comparative Example 1 | 0.928 | 300 | 5 | 400 | $0.6 \times 10^6$ | 60 |
| Comparative Example 2 | 0.928 | 500 | 10 | 800 | $4.0 \times 10^6$ | 55 |
| Comparative Example 3 | 0.936 | 500 | 10 | 800 | $4.0 \times 10^6$ | 50 |
| Comparative Example 4 | 0.936 | 300 | 15 | 400 | $1.8 \times 10^6$ | 55 |
| Comparative Example 5 | 0.941 | 400 | 20 | 900 | $7.2 \times 10^6$ | 40 |
| Comparative Example 6 | 0.941 | 400 | 20 | 500 | $4.0 \times 10^6$ | 50 |
| Comparative Example 7 | 0.925 | 300 | 5 | 400 | $0.6 \times 10^6$ | 60 |

PE: Polyester (1) Whiteout in Character Portion

Images having characters are output on transparent sheets (type DX, manufactured by Ricoh Co., Ltd.) and compared with step by step samples with regard to the frequency of untransferred toner due to which the inside is dropped from line images of character portions. The results are scaled from 1 to 5, in which Rank 5 represents least whiteout and Rank 1 represents most frequent whiteout.

(2) Background Fouling

Outputting blank images is stopped in the middle of development and the developing agent on the image bearing member after development is transferred by an adhesive tape. The image density difference between a blank adhesive tape and the adhesive tape used for transferring the developing agent thereto is measured by a spectrodensitometer (938, manufactured by X-Rite).

(3) Image Density

Image ID on the right side, the left side and the center patch portion of the image chart having a 30% image area is measured by a spectrodensitometer (938, manufactured by X-Rite) and the average is obtained.

Table 3 represents the image evaluation result of Examples 1 to 6 and Comparative Examples 1 to 7.

TABLE 3

| | Whiteout in character portion | Background fouling | Image density |
|---|---|---|---|
| Example 1 | 4 | 0.004 | 1.53 |
| Example 2 | 5 | 0.003 | 1.48 |
| Example 3 | 4 | 0.005 | 1.50 |
| Example 4 | 5 | 0.001 | 1.45 |

TABLE 3-continued

| | Whiteout in character portion | Background fouling | Image density |
|---|---|---|---|
| Example 5 | 4 | 0.006 | 1.55 |
| Example 6 | 5 | 0.003 | 1.39 |
| Comparative Example 1 | 3 | 0.012 | 1.25 |
| Comparative Example 2 | 2 | 0.080 | 1.57 |
| Comparative Example 3 | 3 | 0.009 | 1.41 |
| Comparative Example 4 | 2 | 0.046 | 1.62 |
| Comparative Example 5 | 2 | 0.115 | 1.53 |
| Comparative Example 6 | 3 | 0.073 | 1.49 |
| Comparative Example 7 | 3 | 0.070 | 1.33 |

This document claims priority and contains subject matter related to Japanese Patent Application No. 2007-067715 filed on Mar. 16, 2007, the entire contents of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image formation method comprising:

charging an image bearing member;

irradiating a surface of the image bearing member to form a latent electrostatic image thereon;

developing the latent electrostatic image with a two component developing agent comprising a carrier and a toner comprising a mother toner particle and an external additive by a development device comprising a rotating stirring and transfer device configured to transfer and stir the developing agent;

transferring the developed image to a transfer medium; and fixing the developed image on the transfer medium, wherein the toner comprises a polyol-based resin as a binder resin, the polyol based resin having multiple hydroxyl groups in a molecular chain thereof in which a ratio (EX/OH) of epoxy group (EX) to hydroxyl group (OH) is from 0.990 to 1.010, the stirring and transfer device satisfies the following relationship (I):

$$1.0\times10^6 \leqq \alpha\times\beta\times\gamma \leqq 16.0\times10^6$$

wherein $\alpha$ represents a number of rotation per minute, $\beta$ (mm) represents a pitch and $\gamma$ (mm) represents a transfer path length of the stirring and transfer device, a temperature Tin (° C.) in the development device during stirring and transfer of the two component developing agent satisfies the following relationship (II):

$$30°\ C. < Tin < 60°\ C.,$$

and the toner satisfies the following relationships (III):

$$Y \leqq -0.5X+45,\ 5 \leqq X \leqq 40,\ 5 \leqq Y \leqq 35,$$

wherein X (%) represents a degree of agglomeration of the mother toner particle and Y (%) represents a degree of agglomeration of the toner which has been preserved at 55° C. for 24 hours.

2. The image formation method according to claim 1, wherein the external additive comprises an inorganic particulate and an attachment ratio of the inorganic particulate to a surface of the mother toner particle satisfies the following relationship (IV):

$$65\% \leqq (M_1/M_0) \leqq 95\%,$$

wherein $M_1$ represents an amount of the inorganic particulate attached to the mother toner particle after one minute ultrasonic treatment under a condition of a resonance frequency of 25 KHz for a surface active agent aqueous solution in which the toner is dissolved, and $M_0$ represents an amount of the inorganic particulate attached to the mother toner particle before the ultrasonic treatment.

3. The image formation method according to claim 1, wherein the mother toner particle has an average circularity of from 0.910 to 0.970.

* * * * *